US009755297B2

(12) United States Patent
Chen et al.

(10) Patent No.: US 9,755,297 B2
(45) Date of Patent: Sep. 5, 2017

(54) HOUSING, ELECTRONIC DEVICE USING SAME, AND METHOD FOR MAKING SAME

(71) Applicants: SHENZHEN FUTAIHONG PRECISION INDUSTRY CO., LTD., Shenzhen (CN); FIH (HONG KONG) LIMITED, Kowloon (HK)

(72) Inventors: Wei-Ben Chen, New Taipei (TW); Min Liu, Shenzhen (CN); Chao-Hsun Lin, New Taipei (TW); Chao Lan, Shenzhen (CN)

(73) Assignees: SHENZHEN FUTAIHONG PRECISION INDUSTRY CO., LTD., Shenzhen (CN); FIH (HONG KONG) LIMITED, Kowloon (HK)

( * ) Notice: Subject to any disclaimer, the term of this patent is extended or adjusted under 35 U.S.C. 154(b) by 157 days.

(21) Appl. No.: 14/692,217

(22) Filed: Apr. 21, 2015

(65) Prior Publication Data

US 2016/0185067 A1 Jun. 30, 2016

(30) Foreign Application Priority Data

Dec. 31, 2014 (CN) ..... 2014 1 0847159

(51) Int. Cl.
*H01Q 1/42* (2006.01)
*H01Q 1/24* (2006.01)

(52) U.S. Cl.
CPC ..... *H01Q 1/243* (2013.01); *H01Q 1/425* (2013.01)

(58) Field of Classification Search
None
See application file for complete search history.

(56) References Cited

U.S. PATENT DOCUMENTS

2004/0113860 A1* 6/2004 Walton ..... H01Q 1/002 343/872
2008/0280083 A1* 11/2008 Qiu ..... C25D 3/12 428/35.8
2009/0153412 A1* 6/2009 Chiang ..... H01Q 1/52 343/702
2009/0258246 A1* 10/2009 Wu ..... C23C 18/1653 428/614
2011/0006953 A1* 1/2011 Chiang ..... G06F 1/1616 343/702
2011/0223382 A1* 9/2011 Gu ..... B29C 70/78 428/136
2012/0112970 A1* 5/2012 Caballero ..... H01Q 1/243 343/702
2014/0126172 A1* 5/2014 Fahlgren ..... H01Q 1/243 361/814
2015/0050968 A1* 2/2015 Jeon ..... C25D 5/48 455/575.1

(Continued)

FOREIGN PATENT DOCUMENTS

CN 104168730 A * 11/2014

*Primary Examiner* — Trinh Dinh
(74) *Attorney, Agent, or Firm* — Steven Reiss

(57) ABSTRACT

A housing includes a substrate having an opening, a plurality of metal sheets and a plurality of non-conductive members, the metal sheets are bonded with each other through non-conductive members, forming a metal sheets member, the metal sheets member is located in the opening, the metal sheets member is bonded with substrate through the non-conductive members.

14 Claims, 6 Drawing Sheets

(56) References Cited

U.S. PATENT DOCUMENTS

| | | | | |
|---|---|---|---|---|
| 2015/0241921 | A1* | 8/2015 | Gu | H04M 1/0202<br>361/679.56 |
| 2016/0116948 | A1* | 4/2016 | Ou | G06F 1/1698<br>361/679.56 |
| 2016/0118712 | A1* | 4/2016 | Gu | B29B 11/04<br>343/702 |
| 2016/0120046 | A1* | 4/2016 | Ou | H01Q 9/04<br>343/702 |
| 2016/0185067 | A1* | 6/2016 | Chen | H01Q 1/243<br>343/702 |

* cited by examiner

HOUSING, ELECTRONIC DEVICE USING SAME, AND METHOD FOR MAKING SAME

FIELD

The subject matter herein generally relates to a housing, an electronic device using the housing, and a method for making the housing.

BACKGROUND

Metal housings are widely used for electronic devices such as mobile phones or personal digital assistants (PDAs). Antennas are also important components in electronic devices. But the signal of the antenna located in the metal housing is often shield by the metal housing.

BRIEF DESCRIPTION OF THE FIGURES

Implementations of the present technology will now be described, by way of example only, with reference to the attached figures.

DETAILED DESCRIPTION

Figure 1:
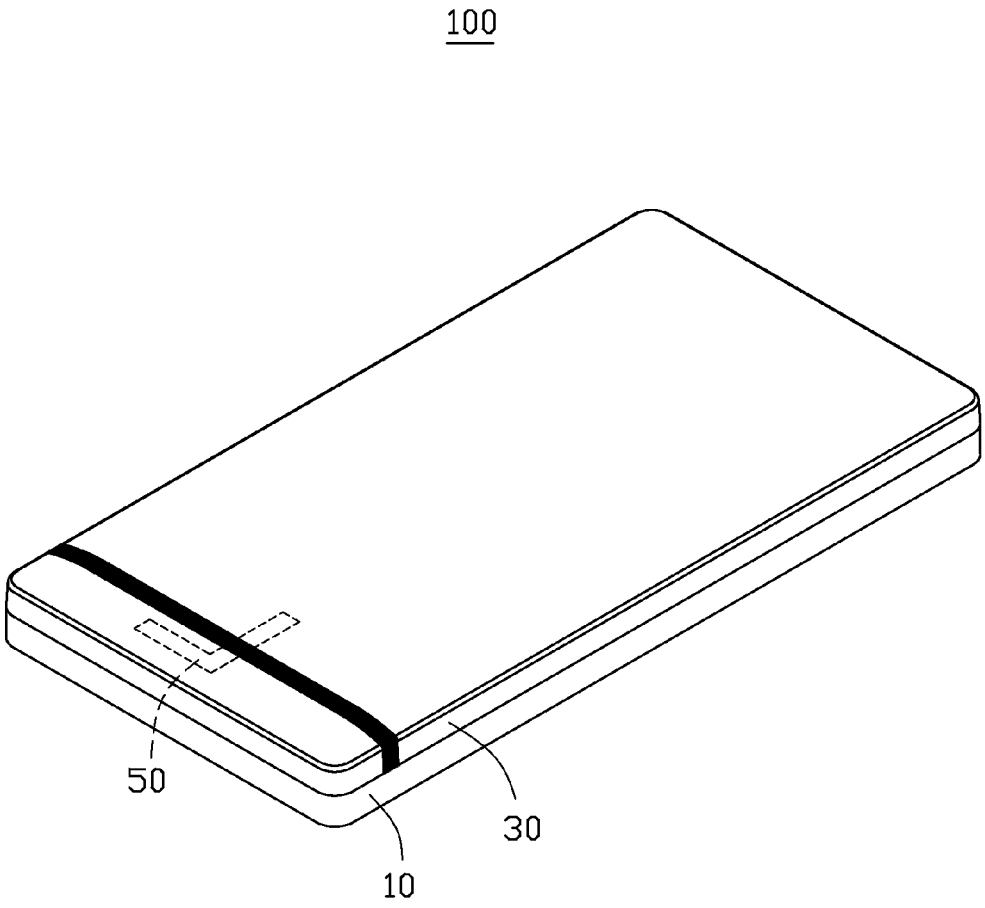
FIG. 1 is an isometric view of an electronic device, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series and the like. The term "coupled" when utilized, means "either a direct electrical connection between the things that are connected, or an indirect connection through one or more passive or active intermediary devices, but not necessarily limited to".

FIG. 1 illustrates an electronic device 100 according to an exemplary embodiment. The electronic device 100 can be, but not limited to, a mobile phone, a personal digital assistant or a tablet computer. In at least one exemplary embodiment, the electronic device 100 can be a mobile phone. The electronic device 100 includes a body 10, a housing 30 assembled to the body 10, and an antenna 50 located inside the body 10.

Figure 2:
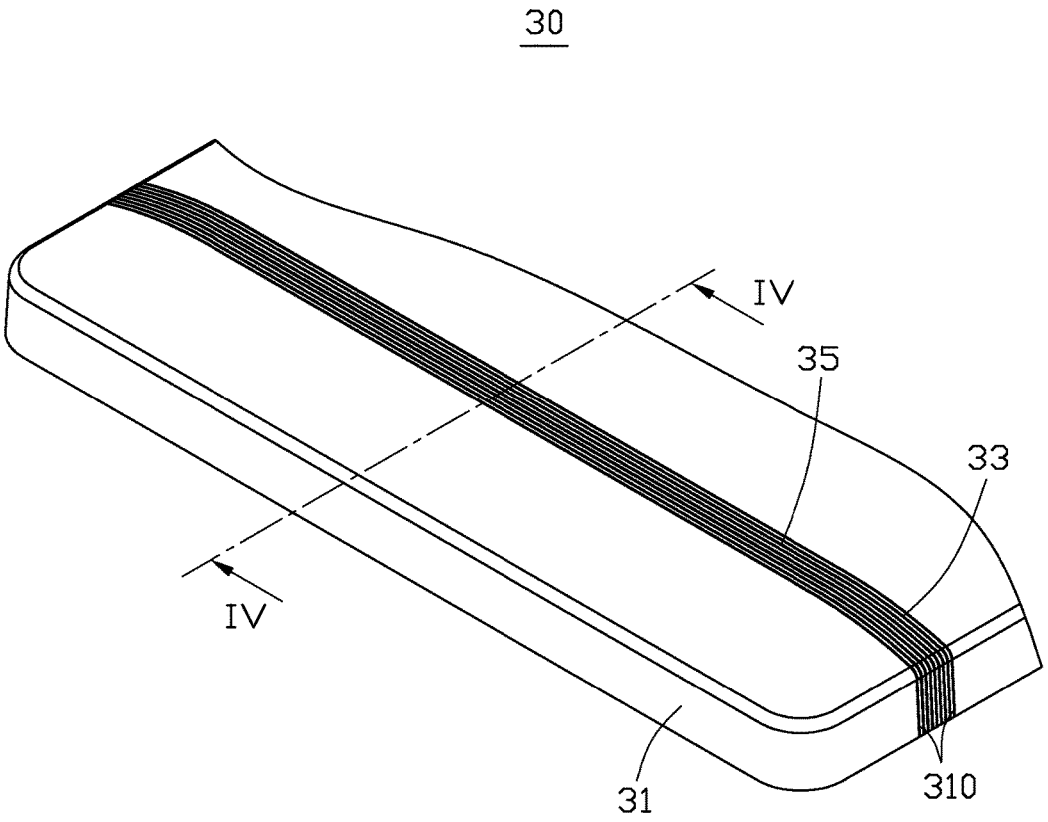
FIG. 2 is an isometric view of a housing of the electronic device shown in FIG. 1.

FIG. 2 illustrates that, in at least one exemplary embodiment, the housing 30 can be a back cover of the electronic device 100. The housing 30 includes a substrate 31, at least one metal sheet 33 and a plurality of non-conductive members 35. In at least one exemplary embodiment, the housing 30 includes a plurality of metal sheets 33.

The substrate 31 can have a desired three dimensional shape. In at least one exemplary embodiment, a cross section of the substrate 31 is substantially "U" shaped, such that the substrate 31 has a receiving space 300 (as shown in FIG. 3).

The receiving space 300 can cooperate with the body 10 to receive internal elements of the electronic device 100, such as the antenna 50, a battery (not shown) and so on.

Figure 3:
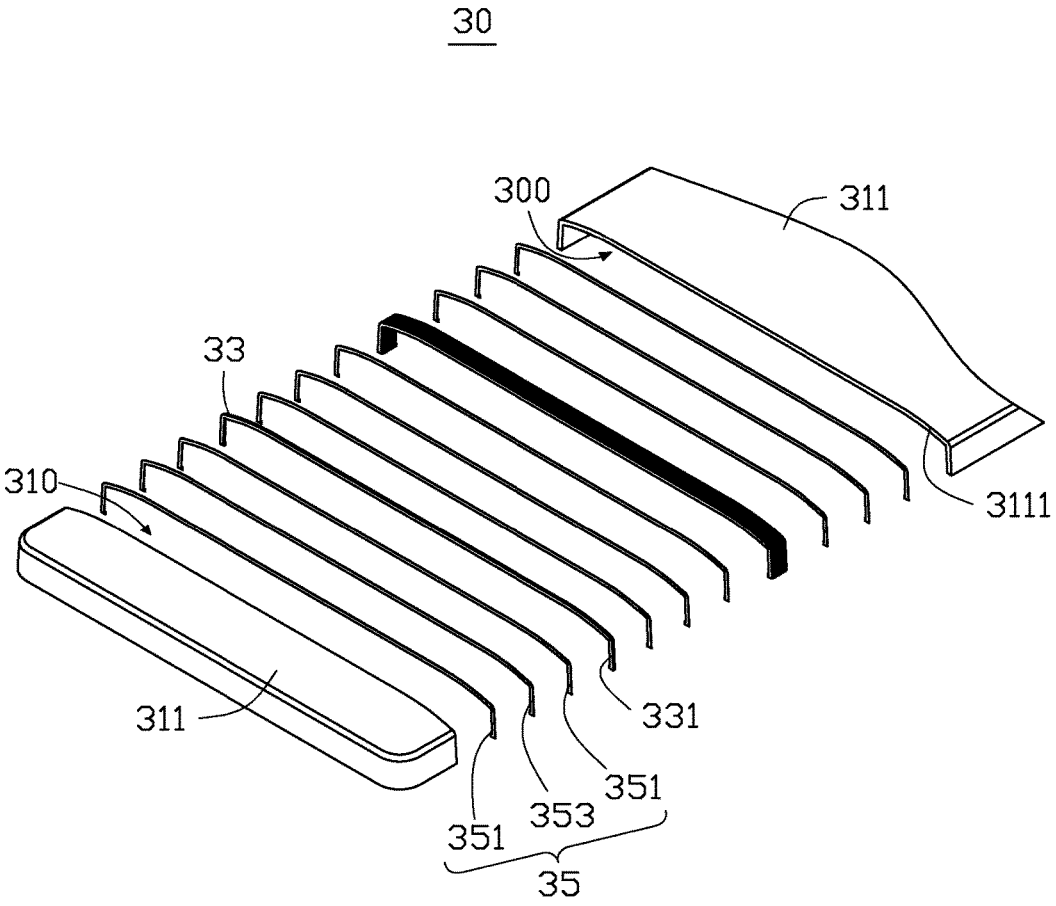
FIG. 3 is an exploded, isometric view of the housing shown in FIG. 2.

FIG. 3 illustrates that the substrate 31 has at least one opening 310 aligning with the antenna 50. The substrate 31 can be separated by the opening 310, and forming at least two main bases 311, in at least one exemplary embodiment, the main bases 311 can be separated from each other. In an alternative exemplary embodiment, the main bases 311 can be connected with each other by an end of the opening 310. The substrate 31 can be made of a metal which can be selected from a group consisting of aluminum, aluminum alloy, titanium, titanium alloy, magnalium and stainless steel.

Figure 4:
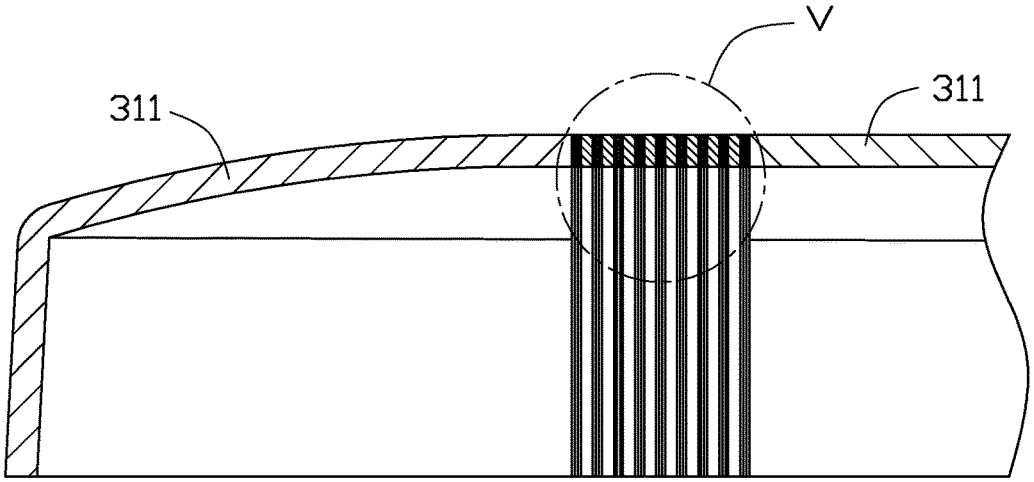
FIG. 4 is a cross-sectional view of the housing along line IV-IV of FIG. 2.

FIG. 4 illustrates that the metal sheets 33 and the non-conductive members 35 can be positioned in the opening 310, each metal sheet 33 can alternate with one non-conductive member 35. The non-conductive members 35 are respectively positioned between two adjacent metal sheets 33, such that the metal sheets 33 can be bonded with each other through the non-conductive members 35, forming a metal sheets member 330. The metal sheets member 330 can be bonded with the main bases 311 through the non-conductive members 35, and each main base 33 is dielectrically connected with one metal sheet 33 adjacent to the main base 33.

Each metal sheet 33 has a width of about 0.1 mm to about 1.0 mm along a direction from an adjacent non-conductive member 35 located at one side of a metal sheet 33 to another adjacent non-conductive member 35 located at an opposite side of the metal sheet 33. The metal sheet 33 can be made of a metal which can be selected from a group consisting of aluminum, aluminum alloy, titanium, titanium alloy, magnalium and stainless steel.

Figure 5:
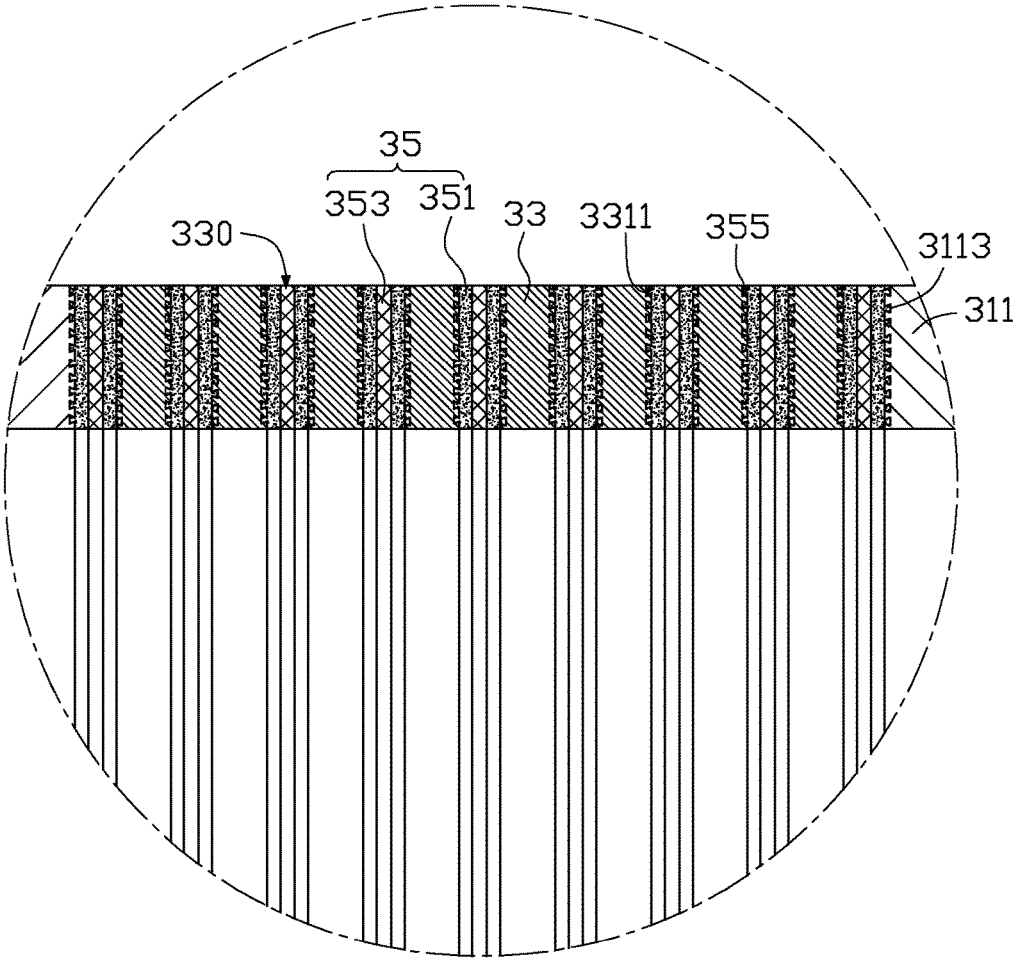
FIG. 5 is an enlarged, isometric view of a circled portion V shown in FIG. 4.

FIG. 5 illustrates that each non-conductive member 35 includes two adhesive layers 351 and an insulative member 353, the two adhesive layers 353 can be formed on two opposite surfaces of the insulative member 353. Each main base 311 can also bond with the metal sheet 33 adjacent to the main base 311 though the adhesive layer 351. The adhesive layers 351 can be made of an adhesive, such as an epoxy resin. The insulative members 353 can support the non-conductive members 35, such that the non-conductive members 35 can be firmly bonded with the metal sheets 33 and the main bases 311. The insulative member 353 can be made of a resin which can be selected from a group consisting of polycarbonate (PC), polyphenylene sulfide (PPS), polybutylene terephthalate (PBT), nylon (PA), polyethylene terephthalate (PET), polyformaldehyde (POM), polypheylene ether (PPE), polybutyleneterephthalate (PBTP). It is to be understood that each non-conductive member 35 can only include the adhesive layer 351. The adhesive layers 351 are respectively located between two adjacent metal sheets 33, and between each main base 311 and one metal sheet 33 adjacent to the main base 311. Each non-conductive member 35 has a width of about 0.2 mm to about 1.0 mm along a direction from an adjacent non-conductive member 35 located at one side of the metal sheet 33 to another adjacent non-conductive member 35 located at an opposite side of the metal sheet 33, such that each space between the two adjacent metal sheet 33 and each space between the main base 311 and the metal sheet 33 adjacent to the main base 311 can both have a width of about 0.2 mm to about 1.0 mm along a direction from an adjacent non-conductive member 35 located at one side of the metal sheet 33 to another adjacent non-conductive member 35 located at an opposite side of the metal sheet 33. As the location of the antenna 50 corresponds to the opening 310, such that signals of the antenna 50 can pass through the spaces and the non-conductive member 35.

FIG. 3 illustrates that one end of each main base 311 has a lateral surface 3111, each metal sheet 33 has two opposite lateral surfaces 331. The lateral surface 3111 has a plurality of holes 3113, the lateral surfaces 331 also have a plurality of holes 3311, the holes 3113, 3311 have a diameter of about 1 nm to about 1 mm.

The diameter of the holes 3113 formed on the main bases 311 can gradually decrease from a direction extend away from the main base 311. The diameter of the holes 3311 formed on the metal sheets 33 can gradually decrease from a direction extend away from the metal sheets 33. Each non-conductive member 35 has a plurality of ribs 355 corresponding to the holes 3113, 3311, the ribs 355 can be engaged in the holes 3113, 3311, such that the non-conductive members 35 can be strongly bond with the main bases 311 and the metal sheets 33.

When the housing 30 is assembled to the body 10, the metal sheets member 330 aligns with the antenna 50. In at least one exemplary embodiment, the main bases 31 can be coupled with the antenna 50, and the main bases 31 can be a part of the antenna 50, signals of the antenna 50 can pass through the non-conductive member 35, such that the antenna 50 can have a high radiatonefficiency.

In alternative embodiments, the main base 31 is not coupled with the antenna 50, such that the main bases 31 is not used as a part of the antenna 50.

Figure 6:
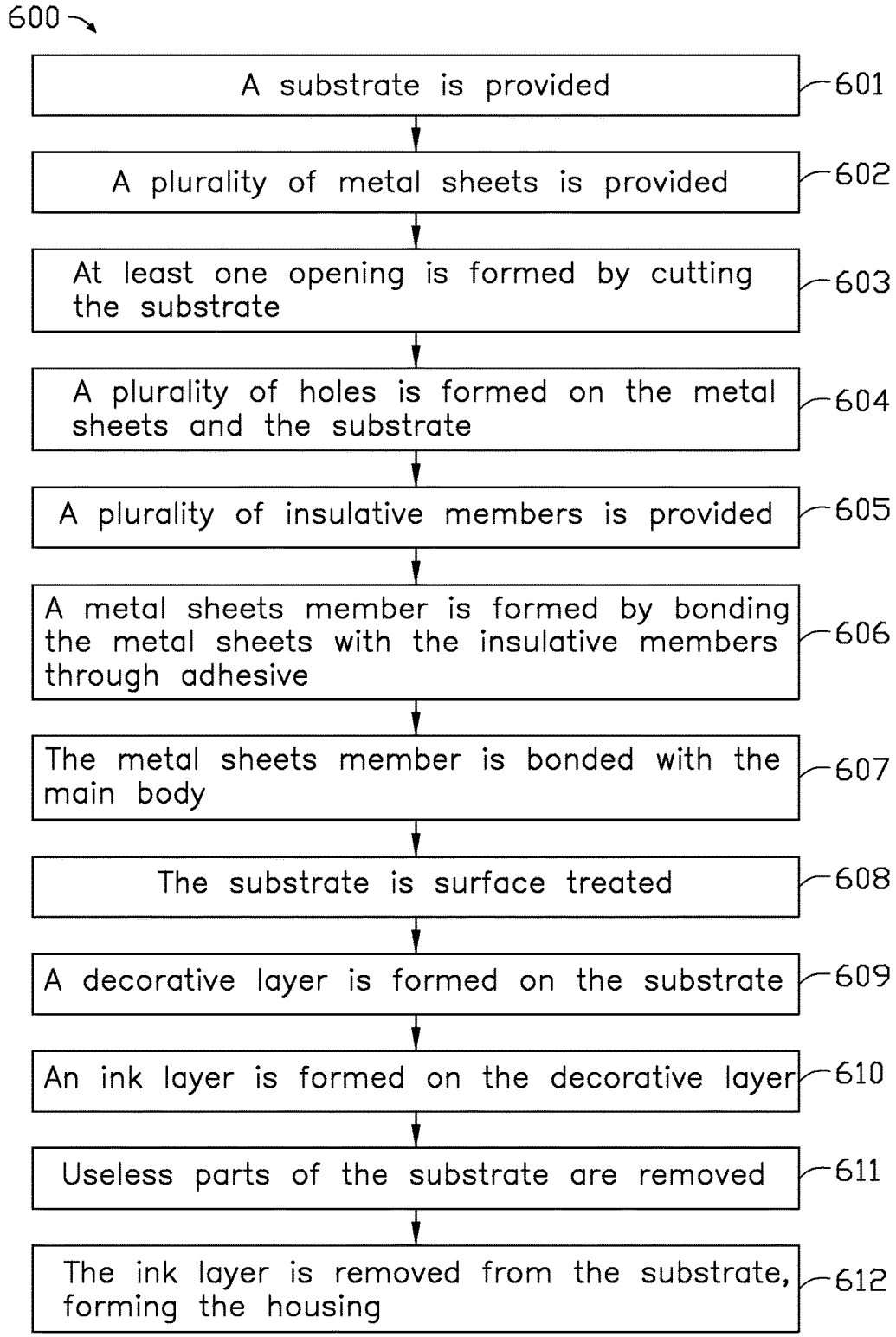
FIG. 6 is a flow chart of a method for making a housing in accordance with an exemplary embodiment.

Referring to FIG. 6, a flowchart is presented in accordance with an exemplary embodiment. The method 600 is provided by way of example, as there are a variety of ways to carry out the method. The method 600 described below can be carried out using the configurations illustrated in FIGS. 1-5, for example, and various elements of these figures are referenced in explaining method 600. Each block shown in FIG. 6 represents one or more processes, methods, or subroutines carried out in the method 600. Furthermore, the order of blocks is illustrative only and the order of the blocks can change. Additional blocks can be added or fewer blocks can be utilized, without departing from this disclosure. The method 600 can begin at block 601.

At block 601, a substrate 31 is provided. The substrate 31 can be made by casting, punching, or computer number control technology (CNC). The substrate 31 can be made of a metal which can be selected from a group consisting of aluminum, aluminum alloy, titanium, titanium alloy, magnesium and stainless steel.

At block 602, a plurality of metal sheets 33 is provided. Each metal sheet 33 has two opposite lateral surfaces 331. The metal sheets 33 can be made by casting, punching, or computer number control technology (CNC). The metal sheets 33 can be made of a metal which can be selected from a group consisting of aluminum, aluminum alloy, titanium, titanium alloy, magnalium and stainless steel.

At block 603, at least one opening 310 is formed by cutting the substrate 31, the opening 310 aligns with an antenna 50. The substrate 31 can be spaced by the opening 310, and forming at least two main bases 311, in at least pone exemplary embodiment, the main bases 311 can be spaced from each other. In an alternative exemplary embodiment, the main bases 311 can be connected with each other by at least one end of the opening 310. Each main base 311 has a lateral surface 3111.

At block 604, a plurality of holes 3113 is formed on the lateral surface 3111, a plurality of holes 3311 is also formed on the lateral surfaces 331. The holes 3113, 3311 can be formed by a dipping process, an electrochemical etching process, a chemical etching process, or an anodic oxidation process. The holes 3113, 3311 are irregular and have a diameter of about 1 nm to about 1 mm. The diameter of the holes 3113 formed on the main base 311 can gradually decrease form a direction extend away from the main base 311. The diameter of the holes 3311 formed on the metal sheets 33 can gradually decrease form a direction extend away from the metal sheets 33.

At block 605, a plurality of insulative members 353 is provided. The insulative members 353 are substantially sheet shaped and can be a resin film which can be selected from a group consisting of polycarbonate (PC), polyphenylene sulfide (PPS), polybutylene terephthalate (PBT), nylon (PA), polyethylene terephthalate (PET), polyformaldehyde (POM), polypheylene ether (PPE), polybutylene-terephthalate (PBTP).

At block 606, a metal sheets member 330 is formed by bonding the metal sheets 33 with the insulative members 353. The metal sheets member 330 can be made by either of the following methods:

In a first method, each lateral surface 331 of the metal sheet 33 can be coated with adhesive, and the insulative members 353 can be respectively placed between two adjacent metal sheets 33 having the adhesive, then the metal sheets 33 having the adhesive and the insulative members 353 can be dried in an oven at a temperature of about 150° C., the drying time can last for about 40 minutes. During the drying process, the insulative members 353 can be melted, then the melted insulative members 353 can be solidified to bond with the metal sheets 33 having the adhesive, forming the metal sheets member 330. The adhesives formed on the lateral surfaces 3311 can be defined as adhesive layers 351.

In a second method, the insulative members 353 can be respectively formed on one lateral surface 331 of each metal sheet 33 by the adhesive layers 315. Each metal sheet 33 coated with the insulative member 353 can bond with one lateral surface 311 of the metal sheet 33 uncoated with the insulative member 353 through the adhesive layers 315, forming the metal sheets member 330.

At block 607, the metal sheets member 330 is bonded with the main bases 311. The lateral surface 3111 of each main base 311 facing the opening 310 and two opposite surface of the metal sheets member 330 can be coated with adhesive, one insulative member 353 can be located in each space between each main base 311 and the metal sheets member 330, then the main bases 311, the metal sheets member 330 and the insulative members 330 can be dried in an oven at a temperature of about 150° C., the drying time can last for about 40 minutes, such that the main bases 311, the metal sheets member 330 and the insulative members 330 can bond together. The metal sheets member 330 is located in the opening 310.

It is to be understood that during the block 606, adhesive can be engaged in the holes 3113, 3311, forming the ribs 3115, 3313.

At block 608, the substrate 31 is surface treated, such that the substrate 31 can have an entire metal appearance. The surface treatment can be a polish process, a surface drawing process, or a grinding process.

At block 609, a decorative layer (not shown) can be formed on an outer surface of the substrate 31, such that the substrate 31 can have a good appearance, and the decorative layer can protect the substrate 31 from being damaged. The decorative layer can be formed through a spraying process, a physical vapor deposition process or an anodic oxidation process.

At block 610, an ink layer (not shown) is formed on the decorative layer, the ink layer can protect the decorative layer from being damaged.

At block 611, useless parts of the substrate 31 are removed by a CNC process.

At block 612, the ink layer is removed from the substrate, forming the housing 30.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A housing comprising:

a substrate having an opening and forming at least two main bases;

a plurality of non-conductive members; and a plurality of metal sheets bonded with each other through the non-conductive members, forming a metal sheets member, the metal sheets member being located in the opening and bonded with the substrate through the non-conductive members;

wherein surfaces of the metal sheets and surfaces of the substrate bonded with the non-conductive members all have a plurality of holes, surfaces of the non-conductive members bonded with the metal sheets and the main bases have a plurality of ribs, the ribs are engaged in the holes.

2. The housing as claimed in claim 1, wherein the substrate is separated by the opening, the main bases are separated from each other.

3. The housing as claimed in claim 1, wherein the holes have a diameter of about 1 nm to about 1 mm.

4. The housing as claimed in claim 1, wherein each non-conductive member has an insulative member and two adhesive layers formed on two opposite sides of the insulative member.

5. The housing as claimed in claim 1, wherein each non-conductive member has an adhesive layer located between each two adjacent metal sheets, and between each main base and one metal sheets adjacent to the main base.

6. The housing as claimed in claim 1, wherein each non-conductive member has a width of about 0.2 mm to about 1.0 mm along a direction from an adjacent non-conductive member located at one side of metal sheet to another adjacent non-conductive member located at an opposite side of the metal sheet.

7. The housing as claimed in claim 1, wherein each metal sheet has a width of about 0.1 mm to about 1.0 mm along a direction from an adjacent non-conductive member located at one side of metal sheet to another adjacent non-conductive member located at an opposite side of the metal sheet.

8. An electronic device, comprising:

a body;

a housing assembled to the body comprising:

a substrate having an opening and forming at least two main bases;

a plurality of non-conductive members; and a plurality of metal sheets bonded with each other through the non-conductive members,forming a metal sheets member, the metal sheets member being located in the opening and bonded with the substrate through the non-conductive members; and an antenna located inside the body, the metal sheets member aligning with the antenna;

wherein surfaces of the metal sheets and surfaces of the substrate bonded with the non-conductive members all have a plurality of holes, surfaces of the non-conductive members bonded with the metal sheets and the main bases have a plurality of ribs, the ribs are engaged in the holes.

9. The electronic device as claimed in claim 8, wherein the substrate is separated by the opening, the main bases are separated from each other.

10. The electronic device as claimed in claim 8, wherein the holes have a diameter of about 1 nm to about 1 mm.

11. The electronic device as claimed in claim 8, wherein each non-conductive member has an insulative member and two adhesive layers formed on two opposite sides of the insulative member.

12. The electronic device as claimed in claim 8, wherein each non-conductive member has an adhesive layer located between each two adjacent metal sheets, and between each main base and one metal sheets adjacent to the main base.

13. The electronic device as claimed in claim 8, wherein each non-conductive member has a width of about 0.2 mm to about 1.0 mm along a direction from an adjacent non-conductive member located at one side of metal sheet to another adjacent non-conductive member located at an opposite side of the metal sheet.

14. The electronic device as claimed in claim 8, wherein each metal sheet has a width of about 0.1 mm to about 1.0 mm along a direction from an adjacent non-conductive member located at one side of metal sheet to another adjacent non-conductive member located at an opposite side of the metal sheet.

* * * * *